US007039975B1

(12) United States Patent
Liao

(10) Patent No.: US 7,039,975 B1
(45) Date of Patent: May 9, 2006

(54) TOOL HAVING DETACHABLE HANDLE MEMBERS

(76) Inventor: Youn Chyuan Liao, No. 68-1, Fusin North Road, Situn, Taichung 40741 (TW)

( * ) Notice: Subject to any disclaimer, the term of this patent is extended or adjusted under 35 U.S.C. 154(b) by 0 days.

(21) Appl. No.: 11/141,966

(22) Filed: Jun. 1, 2005

(51) Int. Cl.
*B25B 15/00* (2006.01)

(52) U.S. Cl. ..... 7/165; 7/90; 7/1; 81/52; 81/177.4; 81/177.85; 81/489; 81/490

(58) Field of Classification Search ..... 7/165, 7/901; 81/52, 177.4, 177.85, 489, 490
See application file for complete search history.

(56) References Cited

U.S. PATENT DOCUMENTS 5,896,606 A * 4/1999 Huang ..... 7/165
6,047,801 A 4/2000 Liao
6,082,226 A 7/2000 Lin
6,173,467 B1 * 1/2001 Chou ..... 7/165
6,405,396 B1 6/2002 Tsai
6,655,243 B1 * 12/2003 Anderson et al. ..... 81/490

* cited by examiner

*Primary Examiner*—Lee D. Wilson
*Assistant Examiner*—Shantese McDonald
(74) *Attorney, Agent, or Firm*—Charles E. Baxley

(57) ABSTRACT

A tool includes a longer handle member having a passage formed in a stem, a cover detachably attached to the longer handle member, a telescopic tool device detachably attached to the cover and engaging through and extendible out of the passage of the stem and having a magnetic element for attracting fasteners. A shorter handle member is detachably attached to the longer handle member, and a ratchet tool mechanism is detachably coupled to the shorter handle member for being driven by the shorter handle member. A magnetic securing device may secure the handle members together. A tool holder may be received in the longer handle member for receiving tool members.

14 Claims, 6 Drawing Sheets

TOOL HAVING DETACHABLE HANDLE MEMBERS

BACKGROUND OF THE INVENTION

1. Field of the Invention

The present invention relates to a tool, and more particularly to a tool having two handle members that may be selectively coupled together, or detached from each other, to form or to provide different lengths for working.

2. Description of the Prior Art

Typical tools comprise a handle, and a driving shank attached or secured to the handle, for being rotated or driven by the handle, and for driving fasteners, tool extensions, or other tool members with the handle. Some of the typical tools may comprise a ratchet driving mechanism attached to the handle or to the driving shank, for suitably rotating or driving the fasteners, the tool extensions, or the other tool members.

For example, U.S. Pat. No. 6,047,801 to Liao, and U.S. Pat. No. 6,082,226 to Lin disclose two of the typical ratchet screw drivers each comprising a ratchet driving mechanism attached to the driving shank of the handle, for suitably rotating or driving the fasteners, the tool extensions, or the other tool members. However, the handle may not be adjusted to different lengths.

U.S. Pat. No. 6,405,396 to Tsai disclose another typical screw driver comprising two handles to be detached from each other or to be secured together, to form or to provide different lengths, for being suitably grasped or held by the users. However, the handles are simply force-fitted together and have no other securing devices or mechanisms to secure the handles together.

The present invention has arisen to mitigate and/or obviate the afore-described disadvantages of the conventional tools or screw drivers.

SUMMARY OF THE INVENTION

The primary objective of the present invention is to provide a tool including two handle members that may be selectively coupled together, or detached from each other, to form or to provide different lengths for working.

In accordance with one aspect of the invention, there is provided a tool comprising a first handle member including a chamber formed therein, and including a stem extended forwardly from a front end thereof, and having a passage formed therein and communicating with the chamber of the first handle member, a cover detachably attached to a rear portion of the first handle member for selectively enclosing the chamber of the first handle member, a telescopic tool device detachably attached to the cover, and engaging through and extendible out of the passage of the stem, and including a magnetic element attached to a free end portion thereof, a second handle member detachably attached to the first handle member, a ratchet tool mechanism detachably coupled to the second handle member, for being driven by the second handle member, the ratchet tool mechanism including a driving shank extended therefrom and having an engaging hole formed therein, and a securing device for securing the first and the second handle members together.

The securing device includes a magnetic member attached to the stem and having a bore formed therein for receiving the telescopic tool device. The first handle member includes an enlarged recess formed in the stem and communicating with the passage of the stem, for receiving the magnetic member.

The first handle member includes a stop secured to the stem and engaged with the magnetic member, to retain the magnetic member in the stem. The stop includes a bore formed therein for receiving the telescopic tool device.

The cover includes a hub extended therein, to receive the telescopic tool device. The cover includes a peripheral channel formed therein, and a peripheral cushioning member received in the peripheral channel of the cover.

The telescopic tool device includes an outer tube attached to the cover, and includes at least one extendible member slidably engaged in the outer tube, and extendible out of the outer tube, and the magnetic element is attached to the extendible member. The outer tube includes a knurled surface formed thereon, for engaging with the stem.

The second handle member includes a space formed therein, for receiving the stem therein, and for detachably attaching the second handle member to the first handle member. The second handle member includes an orifice and at least one slit formed therein, the ratchet tool mechanism includes an extension extended therefrom, for engaging into the orifice of the second handle member, and includes at least one rib extended from the extension for engaging into the slit of the second handle member, for allowing the ratchet tool mechanism to be rotated by the second handle member.

The second handle member includes a length smaller than that of the first handle member. The first handle member includes a tool holder received in the chamber thereof, and having a number of socket openings formed therein, for receiving tool members therein. The tool holder includes a number of spring blades to form the socket openings thereof.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
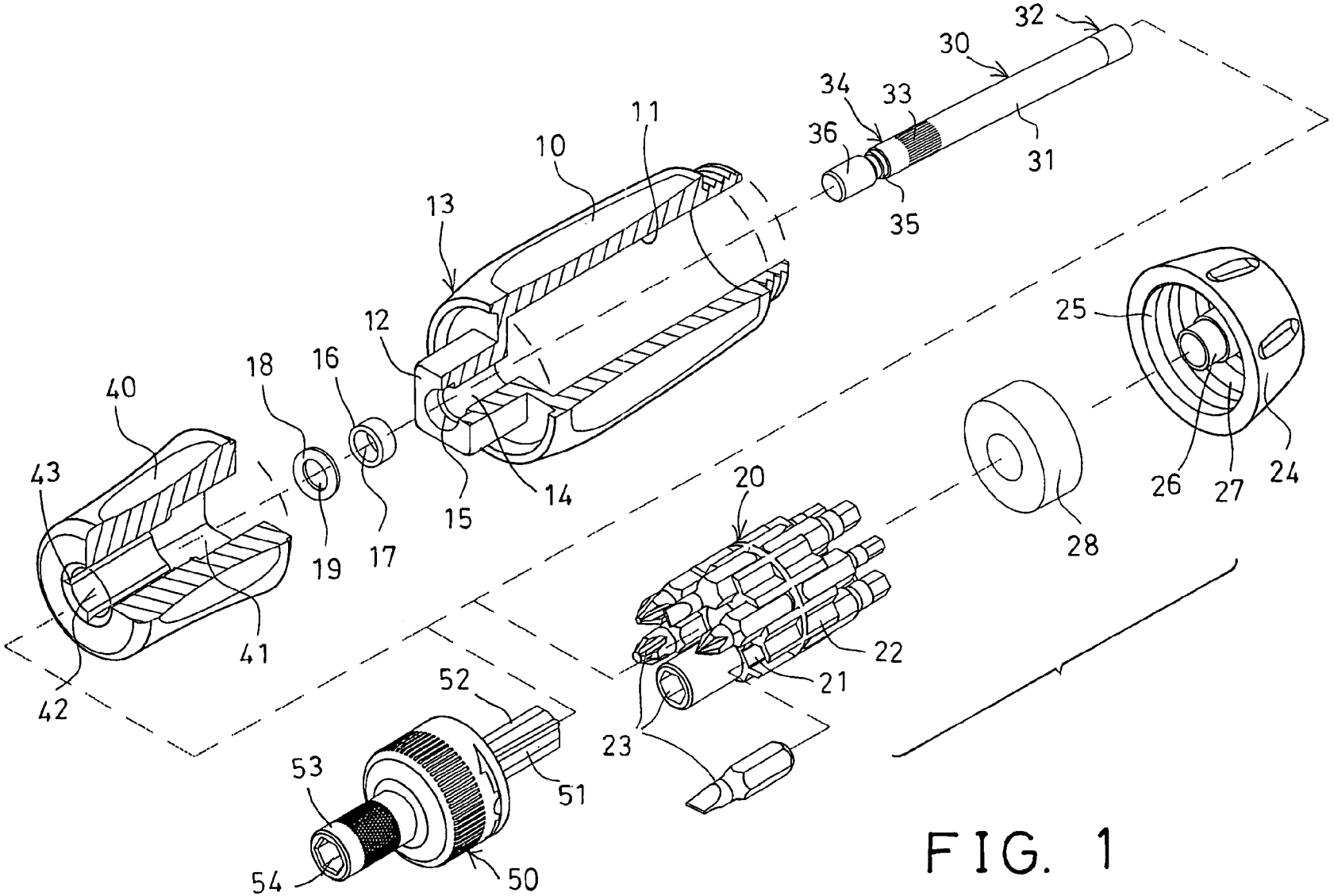
FIG. 1 is an exploded view of a tool in accordance with the present invention.
Figure 2:
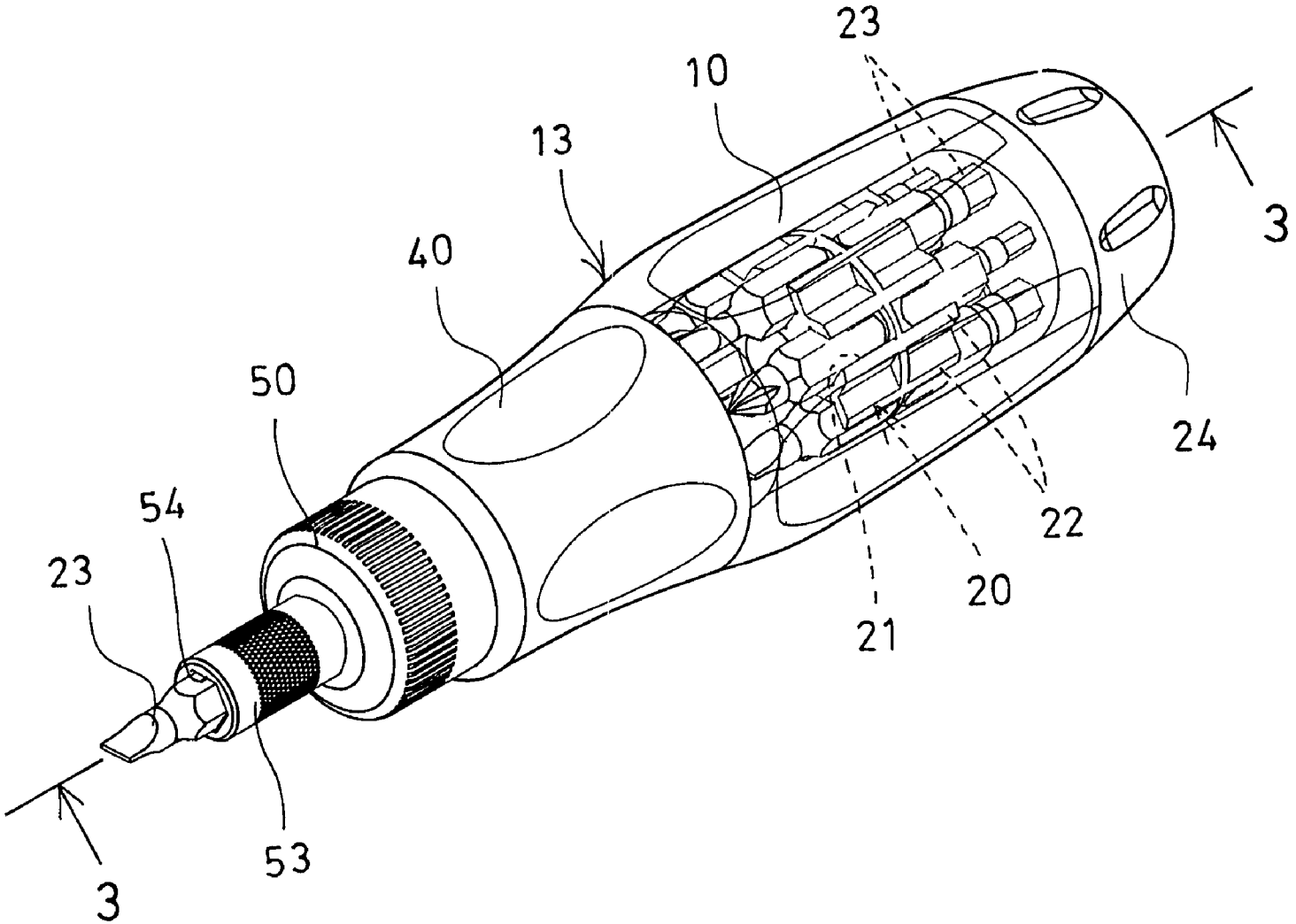
FIG. 2 is a perspective view of the tool.
Figure 3:
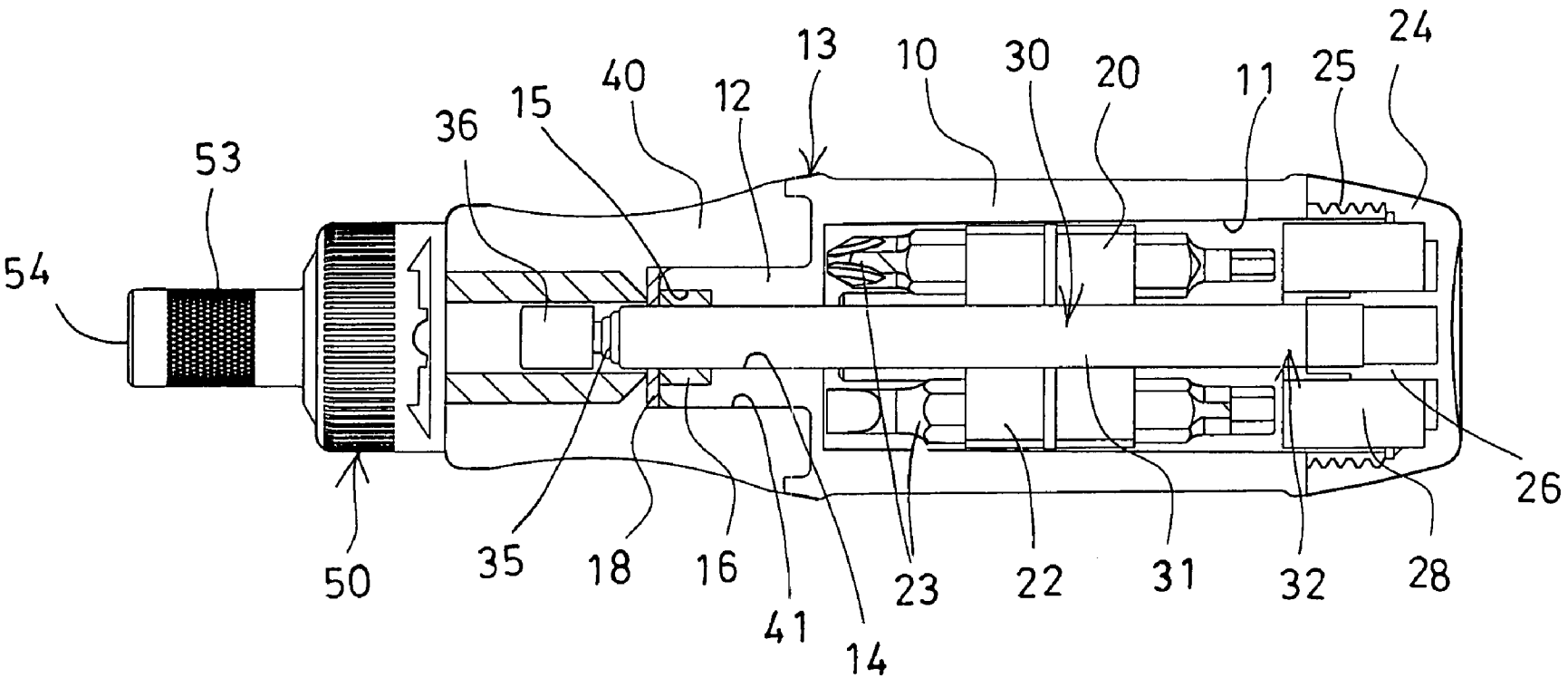
FIG. 3 is a partial cross sectional view of the tool, taken along lines 3—3 of FIG. 2.

Referring to the drawings, and initially to FIGS. 1–3, a tool in accordance with the present invention comprises a first handle member 10 including a chamber 11 formed therein, for receiving a tool holder 20 therein, and including a stem 12 extended forwardly from a front end 13 thereof and having a non-circular cross section, such as a square or rectangular cross section, and having a passage 14 formed therein and communicating with the chamber 11 of the handle member 10, and having an enlarged recess 15 formed in the free end of the stem 12 and communicating with the passage 14 of the stem 12.

The passage 14 of the stem 12 includes an inner diameter smaller than that of the enlarged recess 15 of the stem 12, and also smaller than that of the chamber 11 of the first handle member 10. A magnetic member 16, such as a ring-shaped magnetic member 16 is engaged in the enlarged recess 15 of the stem 12, and secured to the stem 12 of the first handle member 10 with such as force-fitted engagements, or adhesive materials, or the like and includes a bore 17 formed therein and having an inner diameter substantially equals to or no greater than that of the passage 14 of the stem 12.

A washer or a stop 18 may be secured onto the stem 12 of the first handle member 10 with such as adhesive materials, welding processes, fasteners or latches (not shown), or the like, and also includes a bore 19 formed therein and having an inner diameter substantially equals to or no greater than that of the passage 14 of the stem 12 and that of the bore 17 of the magnetic member 16. The stop 18 may be engaged with the magnetic ring member 16, to solidly retain or secure the magnetic ring member 16 within the enlarged recess 15 of the stem 12, and for preventing the magnetic ring member 16 from being disengaged from the stem 12.

The tool holder 20 is detachably received in the chamber 11 of the first handle member 10, and includes a number of socket openings 21 formed therein, and defined by spiders or spring blades 22, for receiving or storing various kinds of tool members 23 therein. A cover 24 may be detachably attached or secured to the rear portion of the first handle member 10 with such as a threading engagement 25, for selectively enclosing the chamber 11 of the first handle member 10, and for stably retaining the tool holder 20 within the chamber 11 of the first handle member 10.

It is preferable that the cover 24 includes a cylindrical hub 26 extended therein, to form or define an annular or peripheral channel 27 therein, and to receive an annular or peripheral soft or resilient or cushioning member 28 therein, in which the soft or cushioning member 28 may be engaged with the tool members 23 and/or the tool holder 20, to stably retain the tool members 23 and/or the tool holder 20 within the chamber 11 of the first handle member 10, best shown in FIG. 3.

A telescopic tool device 30 includes an outer tube 31 having one end or rear end 32 detachably attached or secured to the hub 26 of the cover 24 (FIG. 6), and includes a knurled or serrated peripheral surface 33 formed on the other end 34 of the outer tube 31 (FIG. 1), for force-fitting in or engaging through the passage 14 of the stem 12, for example, and includes one or more extendible members 35 slidably engaged in the outer tube 31, and extendible out of the outer tube 31 and the stem 12 of the handle 10, and extendible through the magnetic member 16 and the stop 18 (FIG. 5), and includes a magnetic element 36 attached or secured to the free end portion thereof, for attracting fasteners or other magnetically attractable elements that are located or dropped into deep or narrow spaces, for example.

Figure 5:
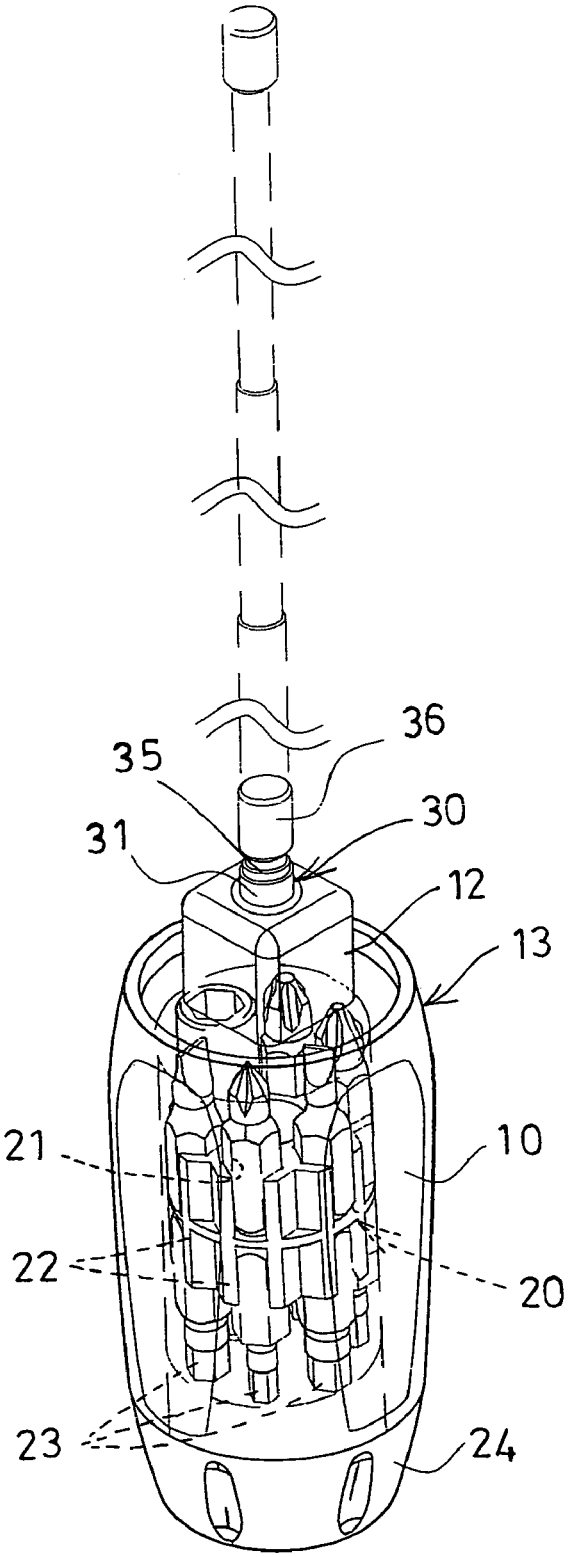
FIG. 5 is another perspective view illustrating the operation of the tool.
Figure 6:
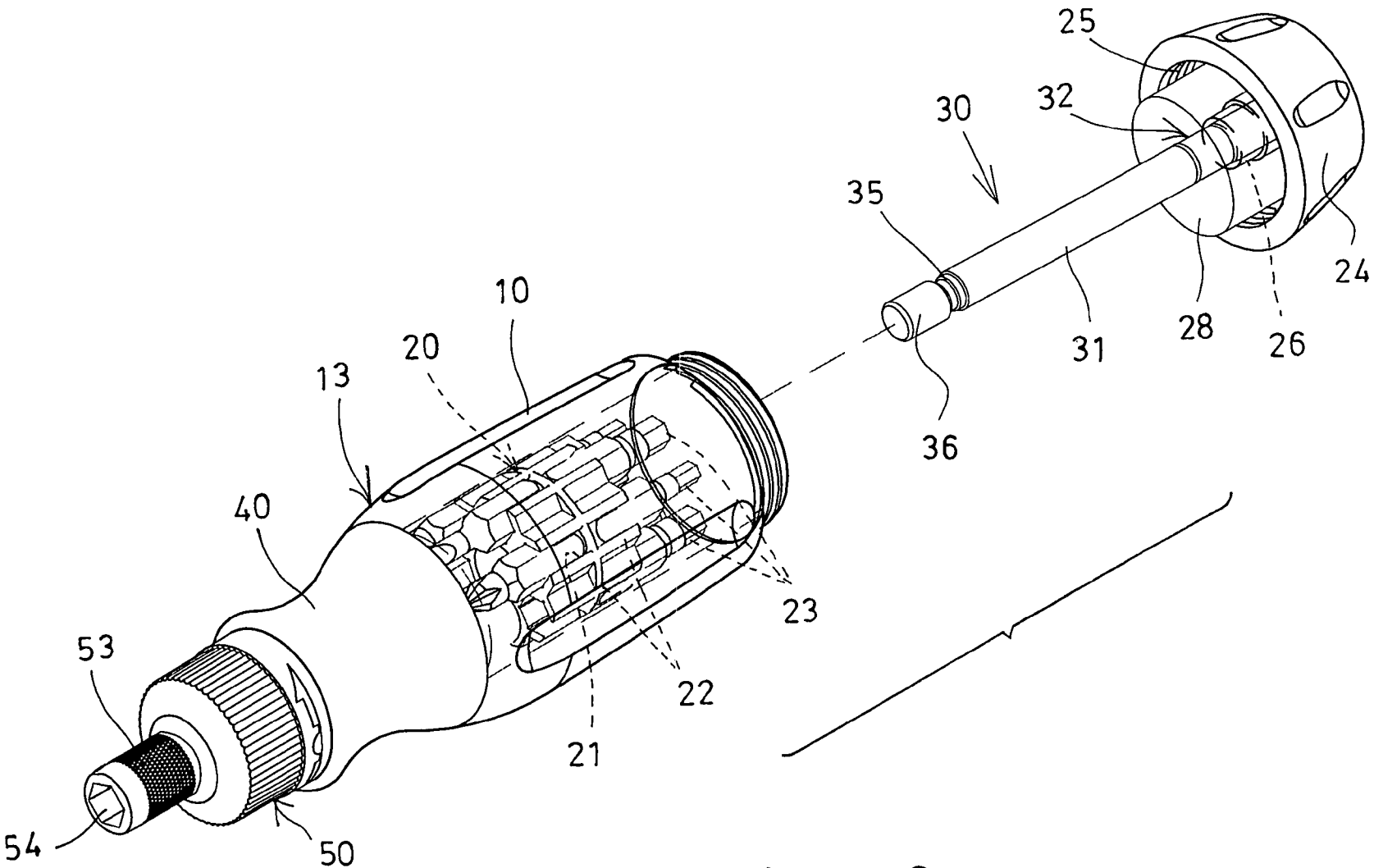
FIG. 6 is a partial exploded view illustrating the operation of the tool.

In operation, as shown in FIG. 5, the extendible members 35 of the telescopic tool device 30 may be extended out of the stem 12 of the first handle member 10, to allow the magnetic element 36 to selectively attract the fasteners or other magnetically attractable elements that are located or dropped into deep or narrow spaces. Alternatively, as shown in FIG. 6, the telescopic tool device 30 may also be directly attached to the cover 24, for being held or operated by the cover 24.

The tool in accordance with the present invention further includes a second handle member 40 having a space 41 formed therein, and having a non-circular cross section, such as a square or rectangular cross section, corresponding to that of the stem 12, for snugly receiving the stem 12 therein, and for allowing the second handle member 40 to be detachably attached to the first handle member 10, and for allowing the first and the second handle members 10, 40 to be solidly coupled together and to be rotated in concert with each other.

It is preferable that the first handle member 10 includes a length smaller than that of the second handle member 40, and provided, particularly, for working in tiny or limited space. The second handle member 40 includes an orifice 42 and one or more slits 43 formed therein. The magnetic member 16 may be formed as a securing means or device to act with the second handle member 40, for attracting or securing the first and the second handle members 10, 40 together.

A ratchet tool mechanism 50 includes an extension 51 extended therefrom, for engaging into the orifice 42 of the second handle member 40, and includes one or more ribs 52 extended from the extension 51 for engaging into the slits 43 of the second handle member 40, and for detachably or solidly coupled the ratchet tool mechanism 50 to the second handle member 40, and for allowing the ratchet tool mechanism 50 to be rotated or driven by the second handle member 40. The ratchet tool mechanism 50 includes a driving shank 53 extended therefrom and having an engaging hole 54 formed therein, for receiving and driving the tool members 23.

Figure 4:
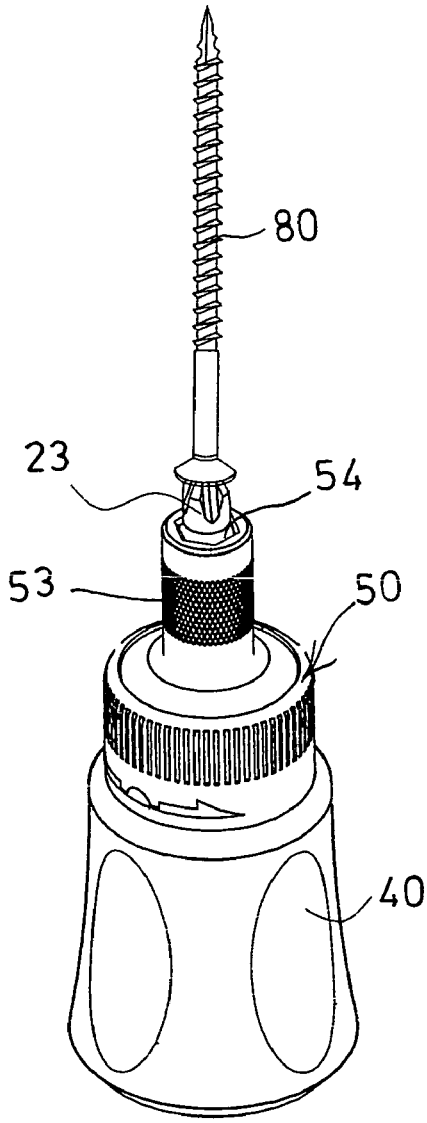
FIG. 4 is a perspective view illustrating the operation of the tool.

Two examples of the ratchet tool mechanism 50 have been disclosed in U.S. Pat. No. 6,047,801 to Liao, and U.S. Pat. No. 6,082,226 to Lin, which may thus be taken as references for the present invention. The ratchet tool mechanism 50 is typical and will not be described in further details. In operation, as shown in FIG. 4, the ratchet tool mechanism 50 may be attached to and rotated or driven by the second handle member 40, for driving fasteners 80. Alternatively, as shown in FIGS. 2 and 3, the ratchet tool mechanism 50 may also be rotated or driven by both the first and the second handle members 10, 40.

As shown in FIGS. 5 and 6, the telescopic tool device 30 may be operated either by the first handle member 10 (FIG. 5), or by the cover 24 (FIG. 6), for selectively attracting the fasteners or other magnetically attractable elements that are located or dropped into deep or narrow spaces.

Figure 7:
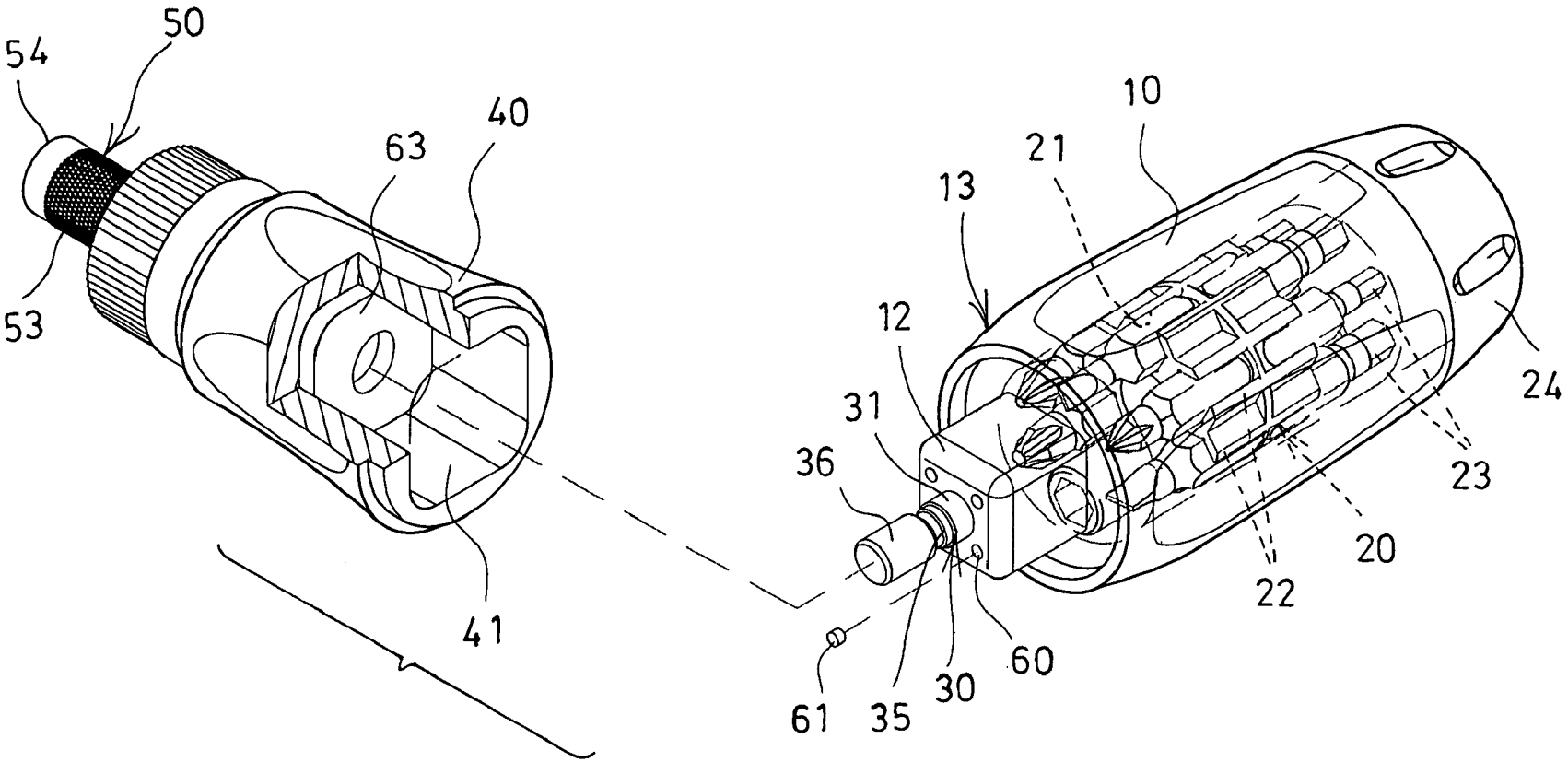
FIG. 7 is a partial exploded view illustrating the other arrangement of the tool.

As shown in FIG. 7, alternatively, the stem 12 of the first handle member 10 may include one or more outwardly facing cavities 60 formed therein, for receiving one or more magnetic members 61 therein, and the second handle member 40 may include another magnetic member 64 attached or engaged therein, for acting with the magnetic members 61 of the stem 12, and for allowing the magnetic members 61, 63 to attract or secure the first and the second handle members 10, 40 together.

Accordingly, the tool in accordance with the present invention includes two handle members that may be selectively coupled together, or detached from each other, to form or to provide different lengths for working.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a first handle member including a chamber formed therein, and including a stem extended forwardly from a front end thereof, and having a passage formed therein and communicating with said chamber of said first handle member, a cover detachably attached to a rear portion of said first handle member for selectively enclosing said chamber of said first handle member, a telescopic tool device detachably attached to said cover, and engaging through and extendible out of said passage of said stem, and including a magnetic element attached to a free end portion thereof, a second handle member detachably attached to said first handle member, a ratchet tool mechanism detachably coupled to said second handle member, for being driven by said second handle member, said ratchet tool mechanism including a driving shank extended therefrom and having an engaging hole formed therein, and means for securing said first and said second handle members together.

2. The tool as claimed in claim 1, wherein said securing means includes a magnetic member attached to said stem and having a bore formed therein for receiving said telescopic tool device.

3. The tool as claimed in claim 2, wherein said first handle member includes an enlarged recess formed in said stem and communicating with said passage of said stem, for receiving said magnetic member.

4. The tool as claimed in claim 2, wherein said first handle member includes a stop secured to said stem and engaged with said magnetic member, to retain said magnetic member in said stem.

5. The tool as claimed in claim 4, wherein said stop includes a bore formed therein for receiving said telescopic tool device.

6. The tool as claimed in claim 1, wherein said cover includes a hub extended therein, to receive said telescopic tool device.

7. The tool as claimed in claim 1, wherein said cover includes a peripheral channel formed therein, and a peripheral cushioning member received in said peripheral channel of said cover.

8. The tool as claimed in claim 1, wherein said telescopic tool device includes an outer tube attached to said cover, and includes at least one extendible member slidably engaged in said outer tube, and extendible out of said outer tube, and said magnetic element is attached to said at least one extendible member.

9. The tool as claimed in claim 8, wherein said outer tube includes a knurled surface formed thereon, for engaging with said stem.

10. The tool as claimed in claim 1, wherein said second handle member includes a space formed therein, for receiving said stem therein, and for detachably attaching said second handle member to said first handle member.

11. The tool as claimed in claim 10, wherein said second handle member includes an orifice and at least one slit formed therein, said ratchet tool mechanism includes an extension extended therefrom, for engaging into said orifice of said second handle member, and includes at least one rib extended from said extension for engaging into said at least one slit of said second handle member, for allowing said ratchet tool mechanism to be rotated by said second handle member.

12. The tool as claimed in claim 1, wherein said second handle member includes a length smaller than that of said first handle member.

13. The tool as claimed in claim 1, wherein said first handle member includes a tool holder received in said chamber thereof, and having a plurality of socket openings formed therein, for receiving tool members therein.

14. The tool as claimed in claim 13, wherein said tool holder includes a plurality of spring blades to form said socket openings thereof.

* * * * *